United States Patent [19]

Rackard et al.

[11] 4,060,950

[45] Dec. 6, 1977

[54] CONCEALED CLIP FOR HOLLOW STRIPS

[75] Inventors: Troy D. Rackard; Grover E. Snider, both of Lexington, N.C.

[73] Assignee: National Gypsum Company, Buffalo, N.Y.

[21] Appl. No.: 748,653

[22] Filed: Dec. 8, 1976

[51] Int. Cl.[2] ..... E06B 3/30; E04C 2/42

[52] U.S. Cl. ..... 52/456; 52/665; 52/668

[58] Field of Search ..... 52/664, 665, 666, 667, 52/668, 669, 456

[56] References Cited

U.S. PATENT DOCUMENTS

| | | | |
|---|---|---|---|
| 3,686,814 | 8/1972 | Anderson | 52/665 X |
| 3,748,814 | 7/1973 | Cribben | 52/668 |

*Primary Examiner*—J. Karl Bell

*Attorney, Agent, or Firm*—Robert F. Hause

[57] ABSTRACT

Intersecting hollow flat strips are adjoined by a concealed semi-rigid thin clip, having the configuration of a wide plus sign. The flat strips have half thickness cutouts to permit interlocking engagement of two intersecting strips, with the thin clip inserted within the cutouts. The thin clips have dimensions and configurations which permit assembly or disassembly with slight force but prevent unintentional disassembly.

5 Claims, 13 Drawing Figures

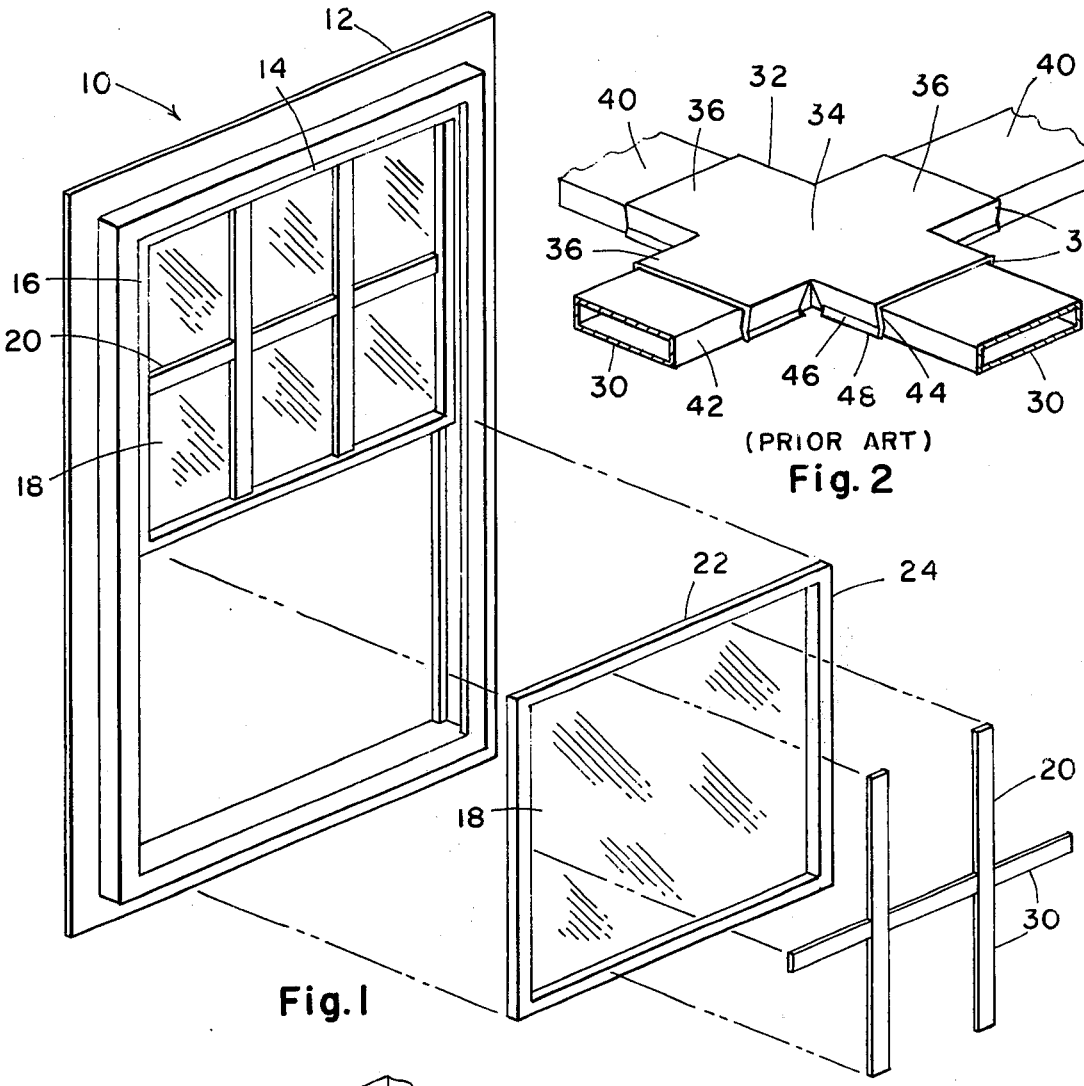
Fig. 1
(PRIOR ART)
Fig. 2
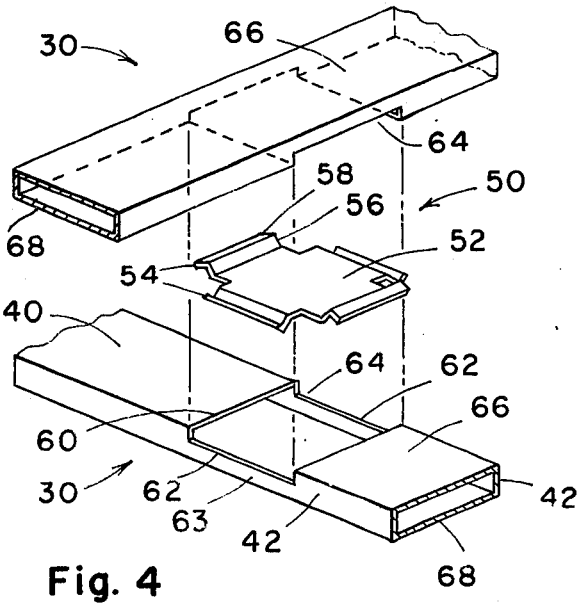
Fig. 4
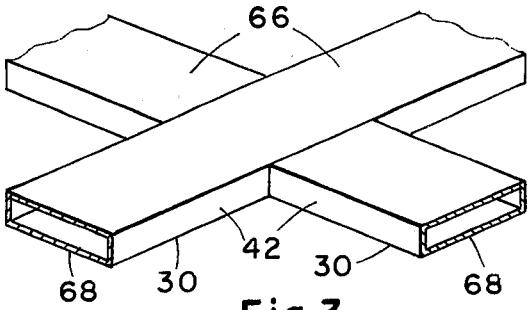
Fig. 3

CONCEALED CLIP FOR HOLLOW STRIPS

This invention relates to a concealed clip for adjoining intersecting hollow flat strips, such as for window muntin grids.

Hollow flat strips have been used to form imitation muntin grids heretofore and intersections have been made by an external clip holding two intersecting strips together.

In both the prior structure and the present invention, the flat strips are cut to half thickness at the points of intersection. The cutout portion in each strip is precisely square so that the opening is a size which exactly hold the remaining square portion of the intersecting strip, and the intersecting strip opening holds the remaining square portion of the first strip. After the two cut strips are placed in interengaged intersecting positions, the two strips have front faces in a common plane and back faces in a second common plane.

In the prior structure, the external clip consisted of a single sheet of metal overlying the intersection of the strips on one face, extending outwardly from the intersection onto a short portion of strip in each of the four directions which the strips extend from the intersection, and having a short grasping flange extending perpendicularly from the main body of the clip, disposed alongside the side edge of each of the portions of strip adjacent the intersection.

The present invention concealed clip is disposed inside the hollow strips, at the intersection, and is formed to hold the intersecting strips firmly together, while still being removable and suitable for reassembling.

It is an object of the present invention to provide a concealed means for joining intersecting hollow strips.

It is a further object to provide such concealed means in a form to be inserted within the openings of two interengaged hollow strips and to extend beyond the openings in four directions, urging the interengaged strips firmly together.

It is a still further object to provide an interlocked pair of intersecting hollow strips with the interlocking means being concealed within the strips.

It is a still further object to provide a novel method of interlocking two intersecting hollow strips.

These and other objects and advantages of the invention will be more readily apparent when considered in relation to the preferred embodiment as set forth in the specification and shown in the drawings in which:

FIG. 1 is an isometric view of a window with clip-in muntin grids made in accordance with the present invention.

FIG. 2 is an isometric view of the junction of a pair of intersecting grid elements, interlocked by a prior art form of external clip.

FIG. 3 is an isometric view of the junction of a pair of intersecting grid elements embodying the present invention.

FIG. 4 is an exploded isometric view of the clip of FIG. 3, revealing the concealed interlocking clip of the present invention.

Figure 5:
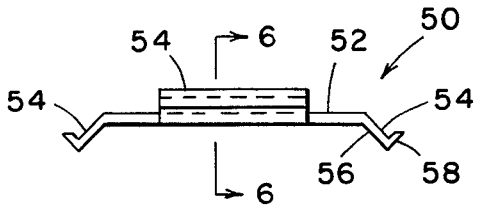
FIG. 5 is an end view of the concealed interlocking clip of FIG. 4.
Figure 6:
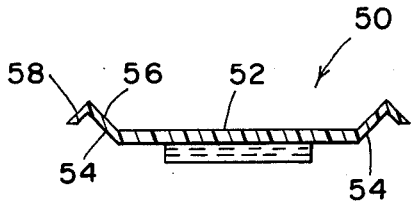
FIG. 6 is a cross-sectional side view of the clip of FIG. 5, taken on line 6—6.
Figure 7:
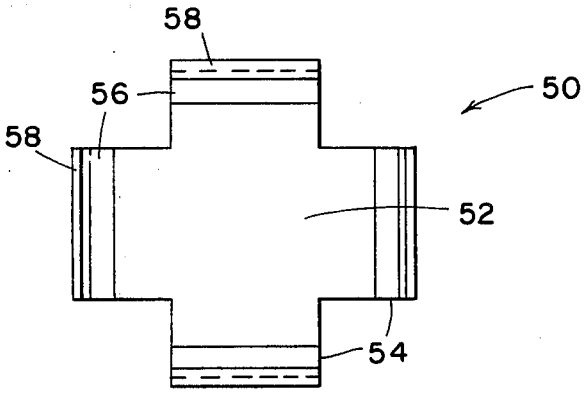
FIG. 7 is a top view of the clip of FIG. 5.

Referring to FIG. 1, there is shown a window 10 including a window frame 12, an upper lite 14 including upper sash 16, glass pane 18, and a clip-in muntin grid 20 and a lower lite 22 which is shown in exploded form with the lower sash 24 and glass pane 18 shown forward of the normal position in frame 12 and the clip-in muntin grid 20 of the lower lite 22 shown still further forward.

It will be seen from FIG. 1 that upper lite 14 and lower lite 22 each consist of a single glass pane 18 and a preassembled muntin grid 20. The muntin grid is made of a plurality of intersecting hollow strips 30.

FIG. 2 shows the prior art clip 32 which was used to hold intersecting hollow strips 30 together. Clip 32 is formed from a flat sheet of thin aluminum sheet, having a flat unbent top face 34 in the form of a cross, including four outwardly extending legs 36, and also having eight downwardly bent flanges 38. The top face 34 conforms to the intersecting face portions 40 of two intersecting hollow strips 30 and the flanges 38 conform to the sides 42 of the two intersecting hollow strips. The flanges 38 each include a very short inward bend 44 and outward bend 46 adjacent the remote edge 48 thereof, for ease of placement of the clip onto the strips 30.

FIGS. 3 and 4 show the intersection of a pair of hollow strips 30 embodying the present invention. In accordance with the invention, the means for locking the strips 30 in intersecting relationship are not seen when the strips are locked together, as will be noted in FIG. 3.

In FIG. 4, the elements of the intersection of the hollow strips 30 are shown in an exploded view, including two hollow strips 30, 30 and the concealed interlocking clip 50, which is disposed within the interior of the two strips 30, 30. Clip 50 is shown also in FIGS. 5, 6, 7 and 8. Clip 50 is preferably a molded plastic, such as a semi-rigid solid nylon.

Clip 50 includes a square center portion 52 and four rectangular outwardly extending legs 54 extending one from each side of center portion 52. At the outer end of each leg 54 there is a first portion 56 which extends out of the plane of center portion 52, two upward and two downward, and a second portion 58 at about 90° thereto which extends back toward the plane of center portion 52.

Each hollow strip 30 has a square cutaway portion 60 in one face 40, extending across the full width of strip 30, adjacent two rectangular cutaway portions 62, 62 in each side 42, 42 with the rectangular cutaway portions 62, 62 being equal in length to the edge of portion 60 and in width being half the width of side 42. Beside each rectangular cutaway portion 62 is a remaining uncut away wall 63 of equal size. By this arrangement of cutaway portions 60 and 62, 62, a total void 64 is created in each of two intersecting strips which permits the two strips to be interengaged at opposed voids with a resultant pair of interengaged strips which are both in the same plane, sharing common top planes 66 and common bottom planes 68.

The dimensions of clip 50 are dependent on dimensions of the hollow strips 30 and the consequent dimensions of the void 64.

Strips 30, in a preferred embodiment are made of 0.024 inch (0.06 cm) thick aluminum sheet formed into a hollow strip of 13/16 inch (2 cm) width and 3/16 inch (½ cm) thickness. Thus the square cutaway portion 60 is a cutaway portion of 13/16 inch (2 cm) square and the rectangular cutaway portion 62 is a cutaway portion which is 13/16 (2 cm) long by 3/32 inch (¼ cm) wide.

Clips 50 have a square center portion 52 which is ½ inch (1¼ cm) square. The length of each of the four outwardly extending legs 54 is such that the total of the length of leg 54 plus the length of one side of center portion 52 is substantially equal to one side of the square cutaway portion 60 of strip 30. Thus outwardly extending legs 54 have a length of about 5/16 inch (¾ cm).

Figure 8:
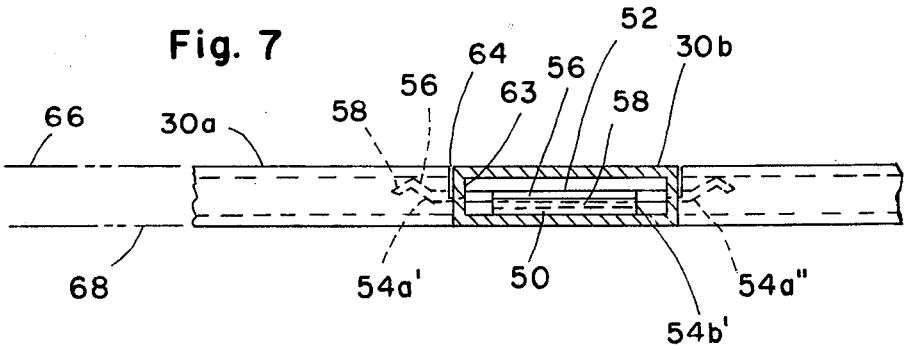
FIG. 8 is a cross-sectional end view of an interlocked intersection of grid elements, showing the clip of FIG. 5 disposed therewithin.

FIG. 8 shows two interlocked hollow strips 30 with clip 50 disposed therewithin, showing how one leg 54*a'* extends beyond the area of void 64 into one hollow strip 30*a*. The first portion 56 and second portion 58 on leg 54*a'* extend up against the underside of the top face of strip 30*a*, urging strip 30*a* upward. Second leg 54*a''* extends into the opposite end of hollow strip 30*a*, with its first portion 56 and second portion 58 on leg 54*a''* also extending up and urging strip 30*a* upward.

One leg 54*b'* is also shown extending in a direction perpendicular to the direction of extent of leg 54*a'* and 54*a''*. Leg 54*b'* extends into the other hollow strip 30*b*. Leg 54*b'* has a first portion 56 and a second portion 58 extending downwardly against the upper side of the bottom face of strip 30*b*, urging strip 30*b* downward. Not seen in this view is a second leg 54*b''* extending in a direction into the paper of the drawing, also with a first portion 56 and a second portion 58 which urge the strip 30*b* downward.

The center portion 52 of clip 50 is held firmly midway vertically (in the drawing) between the two intersecting strips by the fact that two legs 54*a'* and 54*a''* are held downward by the uncut away wall 63, 63 of strip 30*b*, while the two legs 54*b'* and 54*b''* are held upward by the uncut away walls 63 of strip 30*a*.

Figure 9:
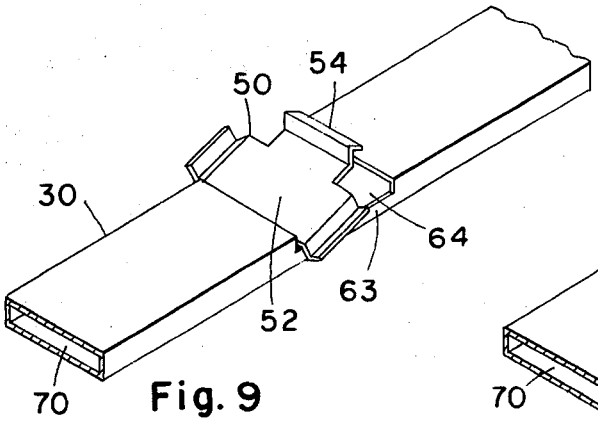
FIGS. 9–13 are isometric views of progressive steps in assembling the elements shown in FIG. 4.
Figure 10:
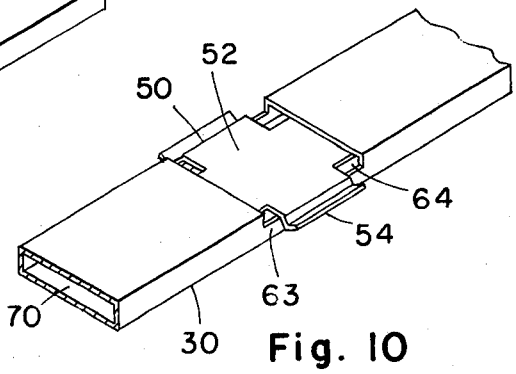

The assembling of clip 50 in a pair of intersecting strips is shown in FIGS. 9 through 13. In FIG. 9, a clip 50 is fitted with one leg 54 all the way into the hollow interior 70 of a hollow strip 30, with center 52 and the opposite leg 54 disposed in void 64. In FIG. 10, the opposite leg 54 is moved half way into the interior 70 on the opposite side of void 64, so that center portion 52 is centered in void 64.

Figure 11:
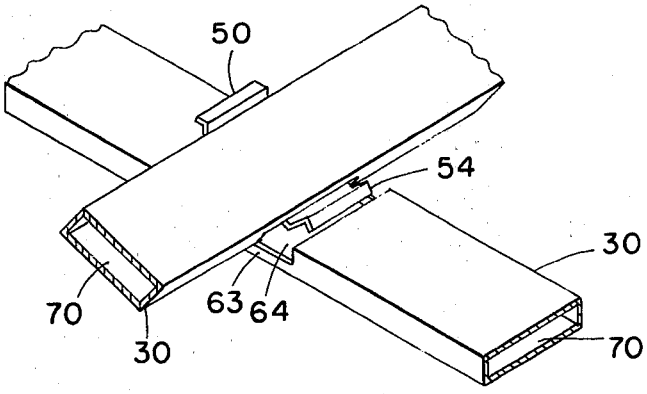
Figure 12:
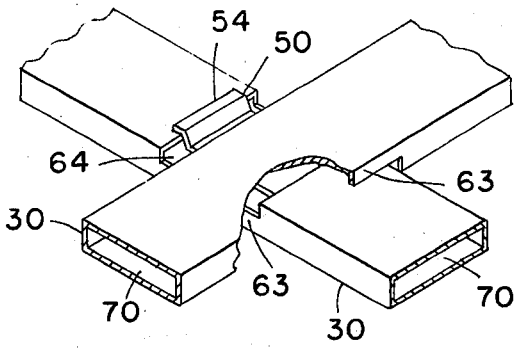
Figure 13:
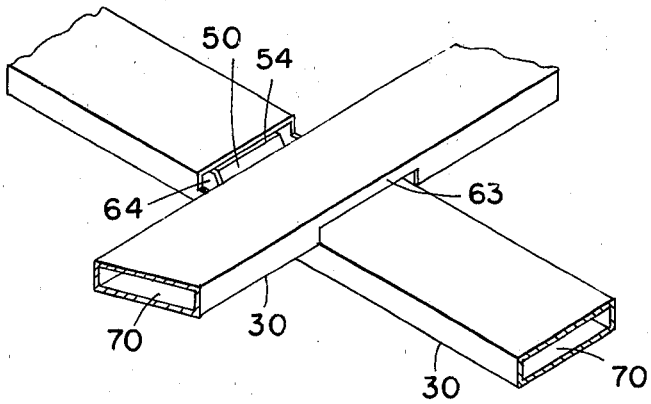

In FIG. 11, one of the two other unengaged legs 54 is inserted into the interior 70 of a second hollow strip 30, adjacent the void 64 therein. The first hollow strip is then moved to force this just engaged leg 54 all the way into the hollow interior of the second hollow strip, while forcing the center 52 of clip 50 to the far side of void 64 of the first hollow strip 30 as shown in FIG. 12. The fourth leg 54 is now free to be inserted into the void 64 of the second hollow strip 30, FIG. 13.

The two hollow strips 30 are then interlocked, with the respective voids 64 engaging the portion of the opposite strip opposite the void, and with the clip having a leg 54 extending in each of four directions into the hollow interiors 70 of the two hollow strips 30, 30.

The hollow interiors 70 have a height of about ⅛ inch (5/16 cm). Clip 50 has a total thickness of about 3/16 inch (½ cm), made up of a center portion thickness of about 3/64 inch (⅛ cm) and first portions 56 which extend upward and downward about 9/128 inch (3/16 cm) out of the planes of the top and the bottom of center portion 52. Thus it will be seen that clip 50 is compressed within the hollow interiors 70 of strips 30, as well as being held in deformed condition by extending over the opposed uncut away walls 63 of the two strips 30.

With the intersecting hollow strips 30 of the muntin grid 20 interengaged and interlocked by clips 50, the muntin grid is mounted adjacent a glass pane 18 in the upper sash 16 or the lower sash 24, or in any other form of window, such as a door window. The muntin grid is affixed to the sash in any known manner, and causes the finished window to appear to be constructed of a plurality of small panes, an appearance which is often aesthetically desirable.

In the embodiment disclosed, the hollow strips 30 are disclosed as intersecting one another at a 90° angle. Some variation from a 90° intersection, such as a 60° intersection, can also be made by forming cutaway sections in the face of the hollow strips in the form of equilateral parallelograms, extending completely across the full width of the strips with 60° and 120° corners. The clips for interlocking the sections would then also be made with parallelogram center portions and with legs extending in the appropriate directions to extend into the hollow interiors of the hollow strips.

Having completed a detailed disclosure of the preferred embodiment of our invention, so that others may practice the same, I contemplate that variations may be made without departing from the essence of the invention or the scope of the appended claims.

We claim:

1. In combination, two intersecting hollow strips of equal cross-sectional dimensions and a concealed clip for interlocking said strips, comprising two hollow strips of equal cross-sectional dimensions each having an equilateral parallelogram cutaway portion on one face, with two sides thereof extending across the full width of said strips, and two rectangular cutaway portions adjacent to said equilateral parallelogram cutaway portion located one in each side of said strip forming an equilateral parallelogram void in each strip extending through half the thickness of said strip, leaving a remaining half thickness opposite thereto, said hollow strips being interengaged with said void of each strip engaging a said remaining half thickness of the other said strip, and a semi-rigid clip disposed within said hollow strips at the intersection formed by said interengagement of said strips, said clips having a center portion and four outwardly directed legs, two oppositely directed legs extending into two oppositely directed portions of one said hollow strip, and two other oppositely directed legs extending into two oppositely directed portions of the other hollow strip, said four outwardly directed legs being formed to urge said two hollow strips together in said interengaged relation including upwardly extending portions on two oppositely directed legs and downwardly extending portions on the two other oppositely directed legs, said upwardly extending portions having a normally upwardly extending extent and said downwardly extending portions having a normally downwardly extending extent such that when said hollow strips are placed fully together in interengaged relation said upwardly extending portions and said downwardly extending portions are still compressed and tending to urge said hollow strips tightly together.

2. The combination of claim 1 wherein said semi-rigid concealed clip consists essentially of a flat center portion and four legs extending outwardly therefrom in a form which is flat for part of the extent and having on the outer ends thereof a first portion extending out of the plane of the said center portion and a second portion extending back toward the plane of the said center portion, with the directions out of said plane of the said first portion of adjacent legs being opposite directions, and being directed toward the face of the respective hollow strip having therein said void.

3. The combination of claim 2 wherein the distance from the end of one of the four legs to a line extending along the farthest side of two opposing legs not including said one leg is substantially equal to the distance between two opposite sides of said equilateral parallelogram cutaway portion.

4. The combination of claim 2 wherein said center portion is a parallelogram having angles substantially equal to the angles of said parallelogram cutaway portion, at least two of said opposed legs have a width at least as great as the length of said legs adjacent thereto, and the total of the width of said two opposed legs plus the length of one of the other of the said four legs is substantially equal to the distance between two opposite sides of said equilateral parallelogram cutaway portion.

5. The combination of claim 4 wherein said semi-rigid concealed clip consists essentially of a flat center portion and four legs extending outwardly therefrom in a form which is flat for part of the extent and having on the outer ends thereof a first portion extending out of the plane of the said center portion and a second portion extending back toward the plane of the said center portion, with the directions out of said plane of the said first portion of adjacent legs being opposite directions, and being directed toward the face of the respective hollow strip having therein said void.

* * * * *